US009896261B2

(12) United States Patent
Chatelain

(10) Patent No.: US 9,896,261 B2
(45) Date of Patent: Feb. 20, 2018

(54) CONTAINER FOR CONSUMER ARTICLES WITH IN DEPTH INNER FRAME

(71) Applicant: PHILIP MORRIS PRODUCTS S.A., Neuchatel (CH)

(72) Inventor: Lucas Chatelain, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/320,812

(22) PCT Filed: Aug. 13, 2015

(86) PCT No.: PCT/EP2015/068617

§ 371 (c)(1),
(2) Date: Dec. 21, 2016

(87) PCT Pub. No.: WO2016/023967

PCT Pub. Date: Feb. 18, 2016

(65) Prior Publication Data

US 2017/0217667 A1 Aug. 3, 2017

(30) Foreign Application Priority Data

Aug. 14, 2014 (EP) ..... 14181081

(51) Int. Cl.
*B65D 85/10* (2006.01)
*B65D 5/66* (2006.01)
(Continued)

(52) U.S. Cl.
CPC ..... *B65D 85/1081* (2013.01); *A24F 15/00* (2013.01); *B65B 11/004* (2013.01);
(Continued)

(58) Field of Classification Search
USPC ..... 206/242, 256, 258, 259, 264, 265, 268, 206/271, 273
See application file for complete search history.

(56) References Cited

U.S. PATENT DOCUMENTS 4,948,038 A * 8/1990 Moeller ..... B65D 5/4291 206/271
5,150,720 A 9/1992 Focke
(Continued)

FOREIGN PATENT DOCUMENTS

CH 380013 7/1964
EP 2433881 3/2012
(Continued)

OTHER PUBLICATIONS

PCT Search Report and Written Opinion for PCT/EP2015/068617 dated Nov. 5, 2015 (11 pages).

*Primary Examiner* — Jacob K Ackun
(74) *Attorney, Agent, or Firm* — Mueting, Raasch & Gebhardt, P.A.

(57) ABSTRACT

A container for consumer articles (20) comprises a box portion (31) comprising a box front wall (32), a box rear wall (36) and two box side walls (38) extending between the box front wall and the box rear wall. The container further comprises an inner frame (10) comprising an inner frame front wall (12) and inner frame side walls (14), wherein the inner frame front wall (12) is arranged parallel and at a predefined distance to the box front wall (32). The container further comprises an additional flap (50) comprising at least two opposing side edges, the first side edge (52) being attached to an upper edge of the box front wall (32), the second side edge (54) contacting the lower edge (12*d*) of the inner frame front wall.

20 Claims, 7 Drawing Sheets

(51) Int. Cl.

| | |
|---|---|
| ***A24F 15/00*** | (2006.01) |
| ***B65B 11/00*** | (2006.01) |
| ***B65B 19/22*** | (2006.01) |
| ***B65D 5/02*** | (2006.01) |
| ***B65D 5/44*** | (2006.01) |

(52) U.S. Cl.
CPC ..... *B65B 19/22* (2013.01); *B65D 5/02* (2013.01); *B65D 5/443* (2013.01); *B65D 5/6691* (2013.01); *B65D 85/1045* (2013.01)

(56) References Cited

U.S. PATENT DOCUMENTS

| | | | | | |
|---|---|---|---|---|---|
| 5,439,105 | A * | 8/1995 | Focke | B65D 5/48048 | 206/256 |
| 6,138,823 | A * | 10/2000 | Focke | B65D 5/4229 | 206/259 |
| 8,136,662 | B2 * | 3/2012 | Aeschlimann | B65D 5/6691 | 206/265 |
| 8,141,701 | B2 * | 3/2012 | Hodges | A24C 5/608 | 206/268 |
| 2005/0150787 | A1 * | 7/2005 | Li Vigni | B65D 85/1081 | 206/271 |
| 2013/0153449 | A1 * | 6/2013 | Agirbas | B65D 5/5023 | 206/273 |

FOREIGN PATENT DOCUMENTS

| | | |
|---|---|---|
| GB | 2151212 | 7/1985 |
| WO | WO 2006/061718 | 6/2006 |

* cited by examiner

CONTAINER FOR CONSUMER ARTICLES WITH IN DEPTH INNER FRAME

This application is a U.S. National Stage Application of International Application No. PCT/EP2015/068617, filed Aug. 13, 2015, which was published in English on Feb. 18, 2016 as International Publication No. WO 2016/023967 A1. International Application No. PCT/EP2015/068617 claims priority to European Application No. 14181081.2 filed Aug. 14, 2014.

The present invention relates to a novel container for housing consumer articles. The containers of the present invention find particular application as containers for elongate consumer articles.

It is known to package consumer articles in containers formed from folded laminar blanks. For example, elongate consumer articles such as cigarettes and cigars are commonly sold in rigid box shaped containers. These containers can be hinged lid containers having a box portion with a lid connected to the box about a hinge line extending across the rear wall of the container. In use, the lid is pivoted about the hinge line to open the pack and provide access to the smoking articles held in the box. In some cases, the container further includes an inner frame partly wrapped around the consumer articles. This may provide further rigidity to the container as well as protect the consumer articles. In cases where the inner frame extends above an upper edge of the box portion, the inner frame typically also provides a surface against which the lid can close.

There is a need to provide containers with an internal volume that is bigger in size than the volume occupied by the consumer articles they hold. This excess internal volume may result in articles being displaced or shaken within the container during transport of the unopened container. The consumer articles are free to move around and may easily be shaken during transport of the container. In the case of cigarettes, this may cause some loose tobacco material to fall out the tobacco rods or the breakage of some cigarettes.

U.S. Pat. No. 5,439,105 discloses a hinge-lid pack made from thin cardboard with a pack part and a lid connected pivotably to the pack part. A one-piece collar consisting of a collar front wall and collar side tabs is arranged in the pack part. The collar partly projects from the pack part and is surrounded by the lid in the closing position. The collar side tabs extend in the region of the inner sides of the side walls of the pack part. At least a middle part region of the collar front wall is set back with respect to the front wall of the pack part, and is arranged inside of the pack part at a distance from the front wall and parallel to the front wall, so that inside the pack part, two upright chambers are created. At least one article is accommodated in each of the upright chambers, which are separated from one another by the collar front wall, and which extend along the entire height of the pack part.

U.S. Pat. No. 5,150,720 discloses a hinge-lid pack for cigarettes, which is specially suitable for situations in which the pack content has a smaller depth than the interior space of the pack. A filling piece is provided in the form of a supporting body which is formed by appropriate folding of a collar front wall from a collar arranged in the pack. An upper portion of the collar front wall is inwardly set back, such that a supporting wall abuts the pack content. Collar side tabs connected to the collar front wall extend across the full depth of the interior space of the pack and are connected to the supporting side walls.

GB 2 151 212 A discloses a hinge-lid pack for cigarettes. The pack comprises a lid portion, a box portion and an inner frame. The complete pack is formed from a single blank. The inner frame includes first and second major panels that are directly connected to the box front wall in a so-called Z-fold. Accordingly the inner frame front wall and the box front wall are arranged parallel and directly adjacent to each other.

EP 2 433 881 A1 discloses a hinge lid container comprising a box portion with a box front wall having a cut out therein. The container further comprises a conventional inner frame mounted within the box and comprising a frame front wall, wherein a portion of the frame front wall is exposed through the cut out portion in the box front wall. The hinge lid is pivotable between a closed position and an open position and comprises an additional lid flap hingedly connected to the lid front wall and folded inwardly towards the inner surface of the lid front wall. Upon closing of the hinged lid, the additional lid flap flicks into the cut out portion of the box front wall and hits against the inner frame front wall. Thereby a sound is created that indicates proper closure of the container. Upon opening the hinge lid, a similar sound is created, when the additional lid flap is released from the cut out portion.

In order to improve audibility of the generated sound, an additional spacer flap is provided at the upper edge of the box front wall. The spacer flap is to be folded inwardly towards the box front wall and is attached to the frame front wall by a suitable adhesive. The box front wall, the spacer and the frame front wall are thus aligned substantially in parallel. Provision of the spacer flap aims at improving the audibility of the generated sound and does not lead to a significant reduction of the internal volume of the container. Further, this document does not teach that the second or lower edge of the spacer flap contacts the lower edge of the inner frame front wall. It would be desirable to provide an improved container for consumer articles such that the consumer articles are effectively held within a given portion of the internal volume of the container before the first consumer article is removed from the container.

It would further be desirable to have a simple solution for such an improved container, which solution allows using conventional manufacturing machinery for production of the containers.

The terms “front”, “rear”, “upper”, “lower”, “above”, “below”, “side”, “lateral”, “top”, “bottom” and other terms used to describe relative positions of the components of containers according to the invention refer to the container in an upright position with an open end of the box portion at the top and the consumer goods accessible from the upper end at the front. The terms “side” and “lateral” are used with reference to side walls of the container when the container is viewed from the front in its upright position.

According to present invention there is provided a container for consumer articles. The container comprises a box portion comprising a box front wall, a box rear wall and two box side walls extending between the box front wall and the box rear wall. The container further comprises an inner frame comprising an inner frame front wall and inner frame side walls, wherein the inner frame front wall is arranged parallel and at a predefined distance to the box front wall. The container further comprises an additional flap comprising at least two opposing side edges, the first side edge being attached to an upper edge of the box front wall, the second side edge contacting a lower edge of the inner frame front wall.

With the container of the present invention, the effective capacity of a container can be easily adapted for packaging a collation of consumer articles having smaller size than the potentially available space inside the container. By modifying the position of the inner frame front wall, the capacity of the container can be easily adjusted to the size of the collation of consumer articles to be packaged in the container. The gap between the box front wall and the inner frame front wall is covered by the additional flap which is provided at the blank of the container. Further modifications of the blanks used for the container of the present invention are not necessary. Thus, already existing conventional machinery equipment can largely be used for manufacture of the container of the present invention.

The contact between the second side edge of the additional flap and the lower edge of the inner frame front wall is a direct contact, which means that the additional flap abuts the lower edge of the inner frame front wall. Moreover, the additional flap contacts the lower edge of the inner frame front wall from below, such that the lower edge of the inner frame front wall is the only portion of the inner frame front wall that is in contact with the additional flap.

Preferably the length of the additional flap is designed such that it basically corresponds to the distance between the upper edge of the box front wall and the lower edge of the inner frame front wall. For reasons of stability and ease of handling the additional flap may have a length that is slightly larger than the distance between the upper edge of the box front wall and the lower edge of the inner frame front wall. The length of the additional flap might be for example about 1 millimeter larger than the distance between the upper edge of the box front wall and the lower edge of the inner frame front wall in order to make sure that the second side edge (or the far end) of the additional flap is safely locked beneath the lower edge of the inner frame front wall. In this way it can be prevented that the additional flap is released from under the lower edge of the inner frame front wall when the consumer inadvertently exerts pressure on the inner frame front wall or when slight deformation of the container occurs.

The predefined distance between the inner frame front wall and the box front wall is 1 millimeter to half of the depth of the container, preferably 3 millimeters to a third of the depth of the container, more preferably 6 millimeters to a third of the depth of the container and in particular preferably 8 millimeters to a third of the depth of the container.

With the structure of the inner frame of the present invention the volume that is used for holding the consumer articles is at least 10 percent, preferably at least 20 percent, further preferably at least 40 percent and even further preferably at least 50 percent smaller, than the internal volume of the container.

In a preferred embodiment the additional flap is hingedly connected to the upper edge of the box front wall. Due to the natural elasticity of the blank material, the hingedly connected additional flap, after having been bent towards the interior of the container, tends to revert back to a co-linear orientation with respect to the box front wall. This natural elasticity ensures that the additional flap tightly abuts the lower edge of the inner frame front wall. At the same time the inner frame front wall prevents the additional flap from bending further upwards.

In a further preferred embodiment the lower edge of the inner frame front wall is substantially at the same height as the upper edge of the box front wall, such that the additional flap extending between the upper edge of the box front wall and the lower edge of the inner frame front wall is oriented orthogonal to the box front wall and the inner frame front wall. This embodiment not only has an appealing design, but the consumer also hardly notices that the container is larger than that is actually required for packing the consumer articles.

In a further preferred embodiment, the additional flap comprises at least one protrusion at at least one of its outer corners at the second side edge, which protrusions are located behind the connection tabs of the inner frame side walls, when the additional flap is folded towards the inner frame front wall. Preferably a protrusion is provided at each outer corner at the second side edge of the additional flap. The protrusions are locked behind connection tabs and therefor provide additional stability to the additional flap. The protrusions can have rectangular shape or can have round edges. Preferably the width of the protrusions corresponds to the thickness of the inner frame blank material.

Preferably, the inner frame front wall comprises reinforcing means for increasing rigidity of the inner frame front wall. In an advantageous embodiment the reinforcing means can be a reinforcing flap attached to the lower edge of the inner frame front wall, the reinforcing flap being folded by 180 degrees upwards and glued to the inner side of the inner frame front wall. In order to increase rigidity further flaps can be incorporated. The additional reinforcing layers need not necessarily be of the same material as the inner frame itself. Additional layers of different materials may be adhered to the inner frame front wall. The layers can be made from cardboard, metal, plastic or any other suitable materials.

The inner frame used in the container of the present invention is less complex and therefore easier to manufacture than the inner frame used in a comparable container as disclosed in U.S. Pat. No. 5,150,720.

Further preferably the container comprises a collation of consumer articles, which is tightly held between the box rear wall and the inner frame front wall. The collation of consumer articles is preferably wrapped in an inner liner so as to provide a bundle of consumer articles.

The present invention is also directed to a process for preparing a container for consumer articles. The process comprises the steps of providing a collation of consumer articles and providing a blank for forming an inner frame, the inner frame comprising an inner frame front wall and inner frame side walls. After folding the inner frame from the inner frame blank, the inner frame is placed on the collation of consumer products. The process further comprises the steps of providing a main blank for forming a container comprising at least a box portion with a box front wall, a box rear wall and two lateral box side walls extending between the box front wall and the box rear wall. An additional flap is provided comprising at least two opposing side edges, the first side edge being attached to an upper edge of the box front wall. The process further comprises the steps of forming a container from the main blank, by folding the main blank around the inner frame and the collation of consumer products, and folding the additional flap such that the second side edge of the additional flap abuts the lower edge of the inner frame front wall.

Preferably, the additional flap is folded by 90 degrees towards the interior of the container, such that the additional flap covers the gap between the upper edge of the box front wall and the lower edge of the inner frame front wall.

In one alternative of the process of the invention the additional flap is folded by 90 degrees before the box front wall of the container is folded onto the collation of consumer articles and the inner frame. This alternative is particularly useful if the material of the main blank is not flexible and therefore the additional flap must be folded in advance such that the second edge of the additional flap already arrives below the lower edge of the inner frame front wall, when the box front wall is folded onto the collation of consumer articles and the inner frame.

In another alternative of the process the additional flap is folded by 90 degrees after the box front wall of the container is folded onto the collation of consumer articles and the inner frame. This alternative is in particular useful when the blank material of the container is a flexible material, like cardboard or paper. Due to the natural elasticity of this material, the additional flap will bend slightly when pressure is applied thereto in order to push the second edge of the additional flap below the lower edge of the inner frame.

Preferably at least one reinforcing flap is attached to the lower edge of the inner frame front wall and the process comprising the further steps of folding the at least one reinforcing flap by 180 degrees upwards and gluing the at least one reinforcing flap to a side of the inner frame front wall. Preferably the reinforcing flap is glued to the side of the inner frame front wall facing towards the interior of the container.

In any of the embodiments described above, the container is preferably filled with elongate smoking articles, such as, for example, cigarettes, cigars or cigarillos. It will be appreciated that through appropriate choices of the dimensions, containers according to the invention may be designed for different numbers of conventional size, king size, super-king size, slim or super-slim cigarettes. However, containers in accordance with the present invention can also be used with a variety of consumer goods other than smoking articles.

Containers in accordance with the present invention may be of a hinged lid design such that the container comprises a lid pivotable along a hinge line, between a closed position and an open position in which consumer goods can be removed from the container. In these embodiments, the hinge lid may be pivotable along a hinge line extending across the rear wall of the box portion, such that the lid also includes a portion of the rear wall.

As well as hinged lid containers, the skilled person will appreciate that the present invention can be applied to containers of alternative design, such as soft packs, that is containers comprising a box portion constructed from a laminar blank made of a thinner, more easily deformable material, such as, paper. Further, the present invention may be conveniently applied to containers having a sliding mechanism for opening the container.

Containers according to the invention will typically be assembled in the conventional way. That is, by folding one or more laminar blanks around the consumer goods and sealing overlying panels of the laminar blanks together in order to retain the container in the assembled shape. This may be achieved using conventional glues or adhesives.

Containers according to the invention may comprise box portions in the shape of a rectangular parallelepiped, with right-angled longitudinal and right-angled transverse edges. Alternatively, the box portion may comprise one or more rounded longitudinal edges, rounded transverse edges, bevelled longitudinal edges or bevelled transverse edges, or combinations thereof.

Through an appropriate choice of the dimensions of the box portion, containers according to the invention may be designed to hold different total numbers of smoking articles, or different arrangements of smoking articles. For example, through an appropriate choice of the dimensions thereof, containers according to the invention may be designed to hold a total of between ten and twenty smoking articles.

The smoking articles in the container may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 millimeters and about 180 millimeters), diameter (for example, between about 4 millimeters and about 9 millimeters). In addition, the smoking articles may differ in strength of taste, resistance to draw and total particulate matter delivery.

The length, width and depth of containers according to the invention may be such that, in the closed position, the resultant overall dimensions of the container are similar to the dimensions of a typical disposable hinge-lid pack of twenty cigarettes.

Preferably, containers according to the invention have a height of between about 60 millimeters and about 150 millimeters, more preferably a height of between about 70 millimeters and about 125 millimeters, wherein the height is measured from the top wall to the bottom wall of the container.

Preferably, containers according to the invention have a width of between about 12 millimeters and about 150 millimeters, more preferably a width of between about 70 millimeters and about 125 millimeters, wherein the width is measured from one side wall to the other side wall of the container.

Preferably, containers according to the invention have a depth of between about 6 millimeters and about 100 millimeters, more preferably a depth of between about 12 millimeters and about 25 millimeters wherein the depth is measured from the front wall to the back wall of the container (comprising the hinge between box and lid).

Preferably, the ratio of the height of the container to the depth of the container is in between about 0.3 to 1 and about 10 to 1, more preferably between about 2 to 1 and about 8 to 1, most preferably between about 3 to 1 and 5 to 1.

Preferably, the ratio of the width of the container to the depth of the container is between about 0.3 to 1 and about 10 to 1, more preferably between about 2 to 1 and about 8 to 1, most preferably between about 2 to 1 and 3 to 1.

Containers according to the invention may be shrink-wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more tear tapes. In addition, the over wrapper may be printed with images, consumer information or other data. The additional outer wrapper may advantageously protect the surface of the container for example against abrasion during handling.

As well as housing a group of smoking articles, the container may also comprise other consumer articles, for example matches, lighters, extinguishing means, breath-fresheners or electronics. The other consumer articles may be attached to the outside of the container, contained within the container along with the smoking articles, in a separate compartment of the container or combinations thereof.

The exterior surfaces of containers according to the invention may be printed, embossed, debossed or otherwise embellished with manufacturer or brand logos, trademarks, slogans and other consumer information and indicia.

The invention will be further described, by way of example only, with reference to the accompanying drawings in which.

Figure 1:
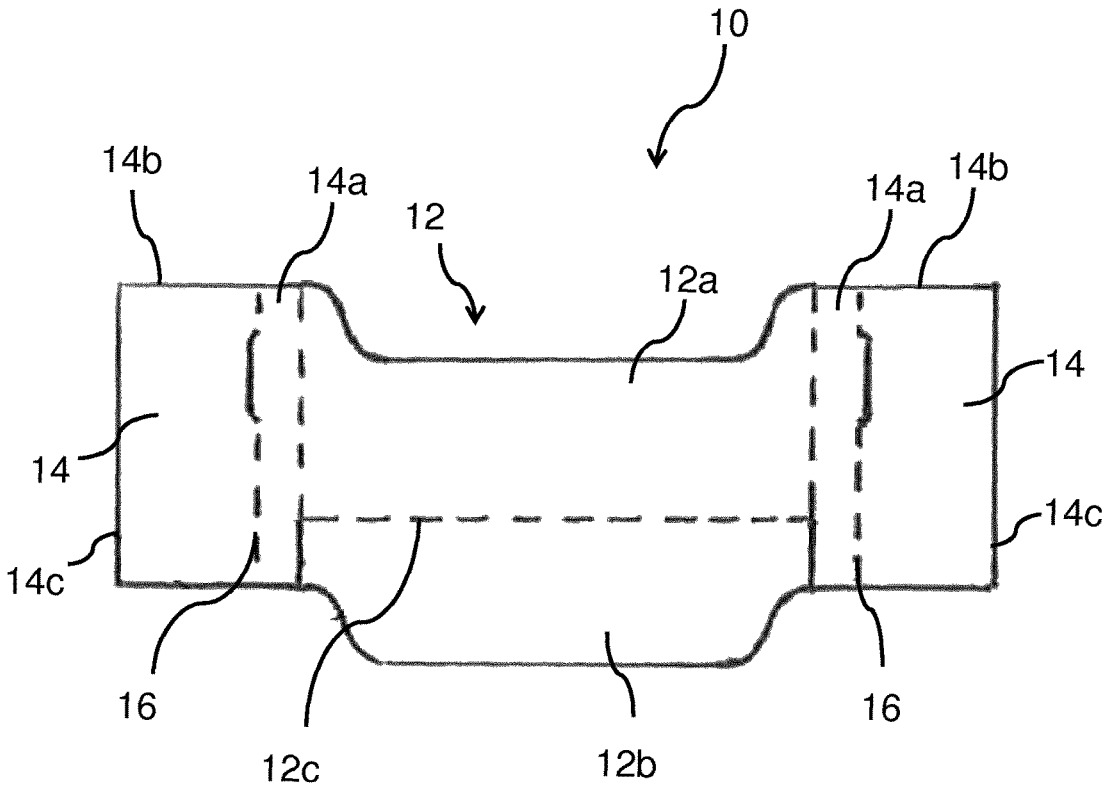
FIG. 1 shows a laminar blank for an inner frame to be used in a container according to the present invention.
Figure 2:
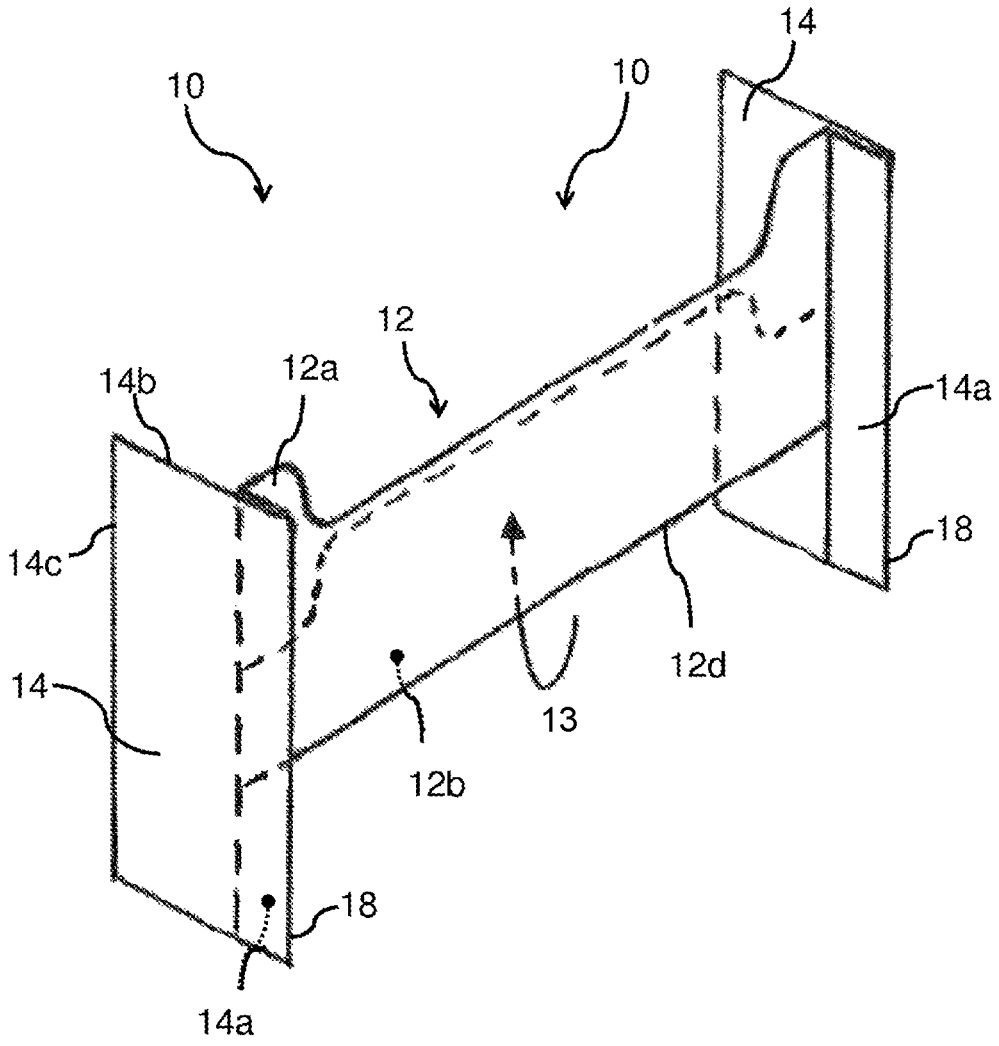
FIG. 2 shows the inner frame of FIG. 1 after folding.
Figure 7:
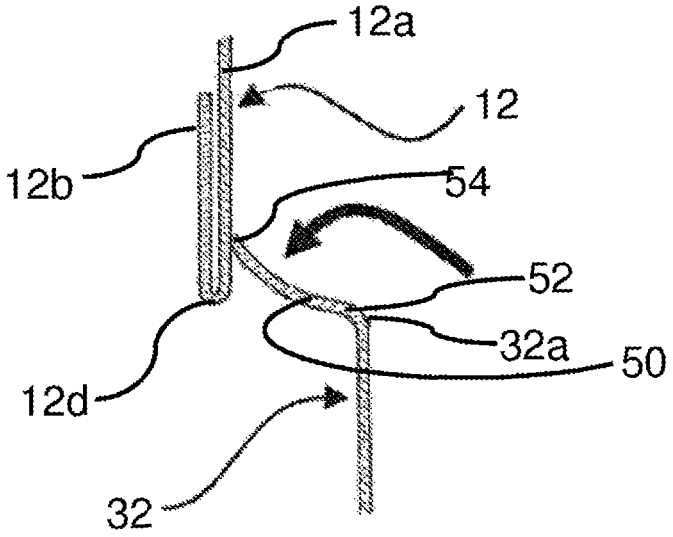
Figure 8:
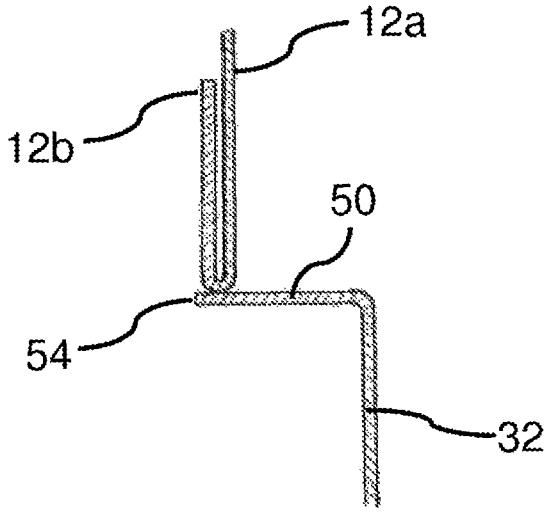

FIGS. 7 and 8 cross-sectional views of the inner frame front wall and the upper end of the box portion front wall;

FIGS. 1 and 2 show the laminar blank for the inner frame before (FIG. 1) and after folding (FIG. 2). The laminar blank 10 comprises an inner frame front wall 12 and left and right inner frame side walls 14. By folding the left and right inner frame side walls 14 along folding lines 16, the inner frame front wall 12 is set back from the front edge 18 of the inner frame side walls 14 by a distance corresponding to the width of the connection tabs 14*a*.

The lower part 12*b* of inner frame front wall 12 represents a reinforcing flap which is folded upward by 180 degrees along folding line 12*c* (as indicated by the arrow 13 in FIG. 2) and is glued to the upper part 12*a* of the inner frame front wall 12. Inner frame front wall 12 is thus formed from a double layer of the inner frame material, increasing the stiffness and stability of the inner frame 10.

Figure 3:
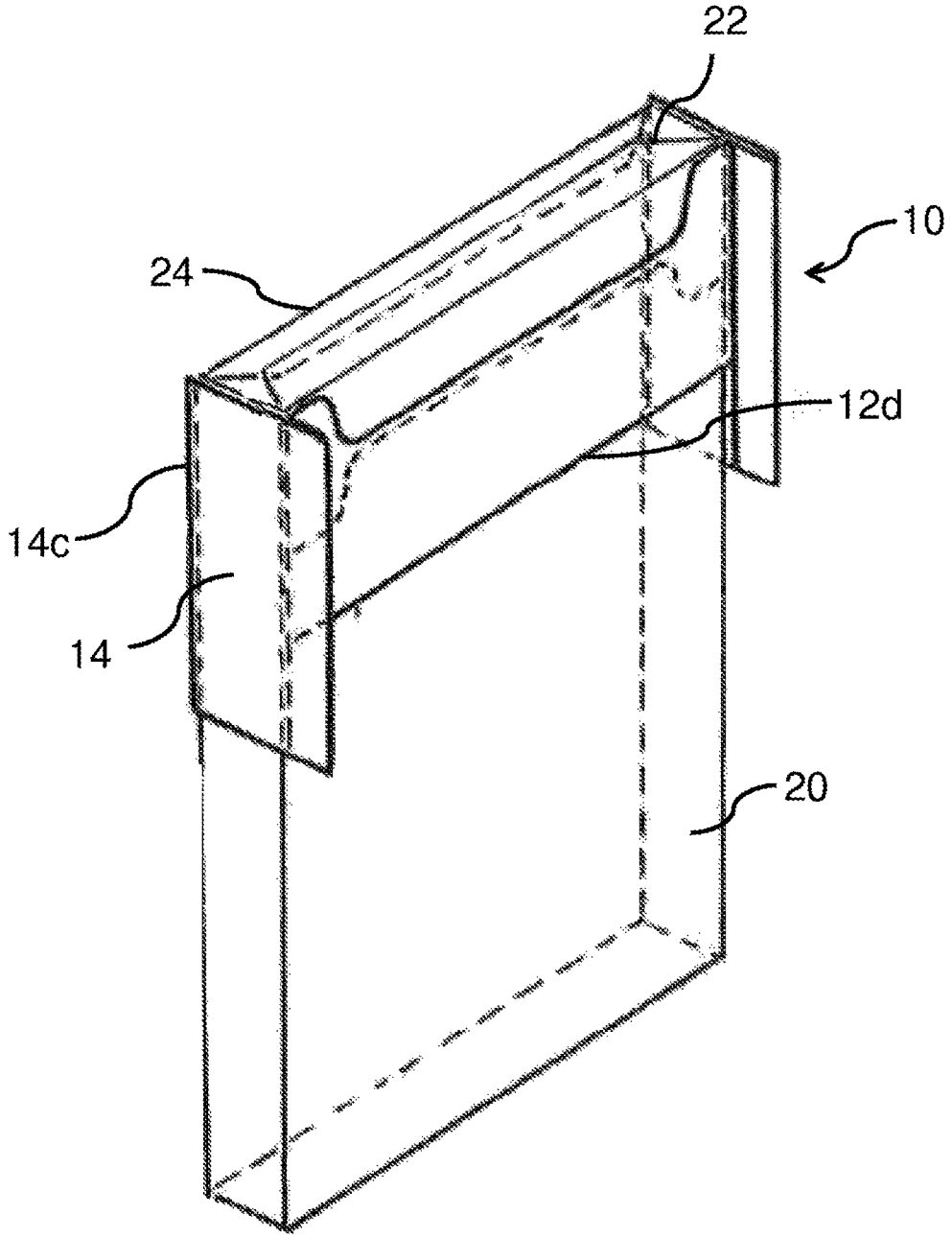
FIG. 3 shows the inner frame of FIG. 2 placed on a collation of cigarettes.

FIG. 3 shows the inner frame 10 of FIG. 2 placed on a bundle of consumer articles 20. The bundle of consumer articles 20 is wrapped by an inner liner 22 and has a generally rectangular shape. The dimensions of the inner frame 10 correspond to the dimensions of the bundle of consumer articles 20. Accordingly the width of bundle 20 is such that it smoothly fits within the inner frame side walls 14. The depth of bundle 20 corresponds to depth of the inner frame 10 defined by the distance between the rear edge 14*c* of the inner frame side walls 14 and the inner frame front wall 12. Further, the upper edges 14*b* of the inner frame 10 and the upper face 24 of bundle 20 are aligned with respect to each other.

Figure 4:
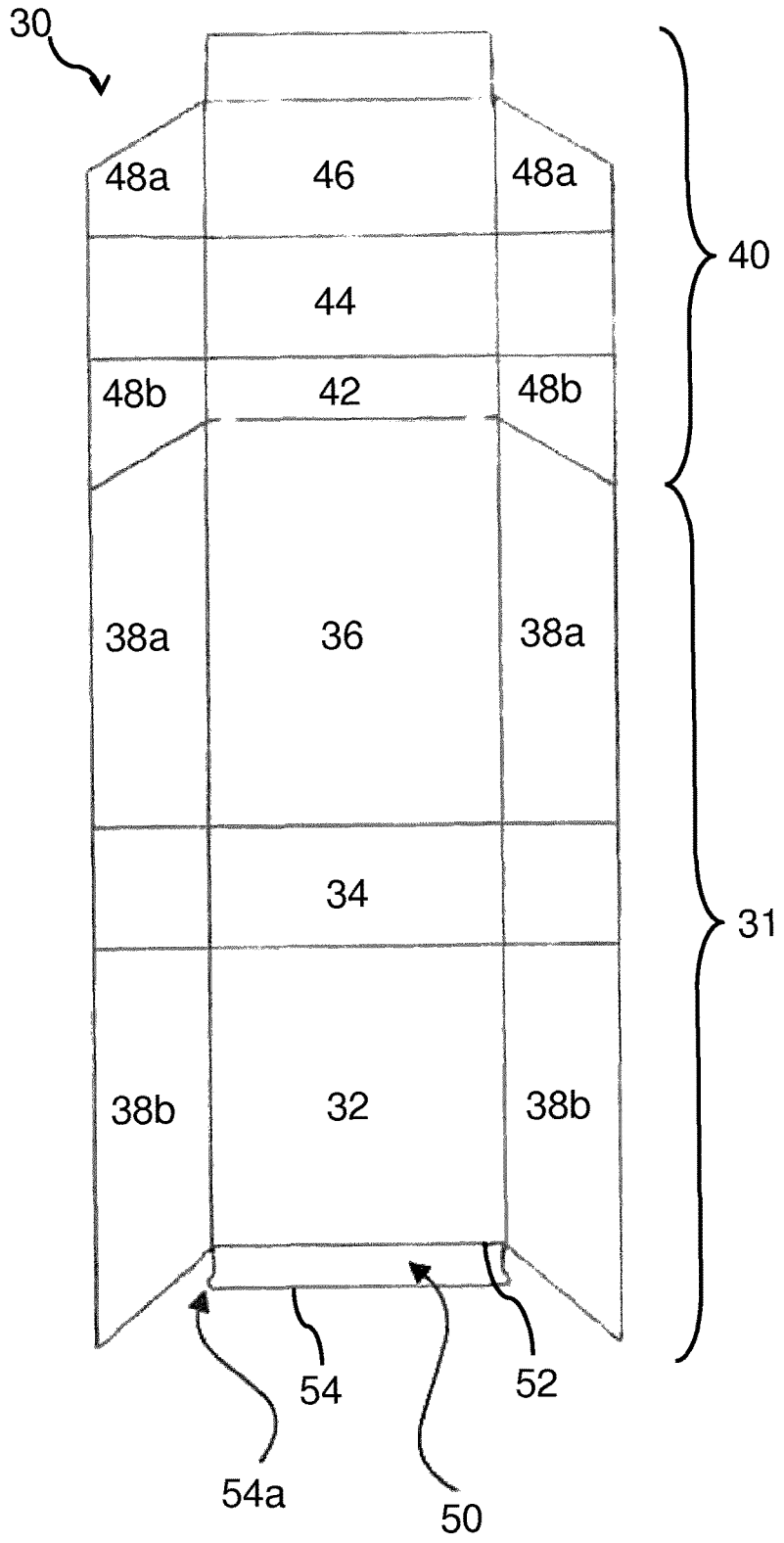
FIG. 4 shows a laminar blank for a hinged lid container to be assembled with the inner frame of FIGS. 1 and 2.

FIG. 4 shows a laminar blank 30 for a hinge-lid pack according to the present invention. The blank 30 and the hinge-lid pack produced from it possess, in the region of the box portion 31, a box front wall 32, adjoining the latter a box bottom wall 34 and a box rear wall 36. Lateral box side walls 38 are each formed by two side tabs 38*a* and 38*b* overlapping one another. The side tabs 38*b* connected to the box front wall 32 are located on the outside.

The lid portion 40 of the hinge lid pack consists of a lid rear wall 42, of a lid top wall 44 and of a lid front wall 46. Lid side tabs 48*a*, 48*b* overlapping one another serve for forming lid side walls 48. The lid portion 40 is connected to the rear wall 36 of the box portion 31 in the region of the lid rear wall 42 via a hinged connection.

An additional flap 50 is provided adjacent to the box front wall 32. The additional flap comprises first and second side edges 52, 54. The additional flap 50 is provided adjacent to the edge of the box front wall 32 which corresponds to the upper edge of the box front wall 32 when the blank 30 is folded to a pack. In the embodiment shown the first side edge 52 of the additional flap 50 is hingedly connected to the upper edge of box front wall 32.

At the corners of the second edge 54 of the additional flap 50, protrusions 54*a* are provided. When the box portion is folded onto the cigarette bundle 20 and the inner frame 10, the protrusions are located behind connection tabs 14*a* and assist in maintaining the additional flap 50 in the desired position.

Figure 5:
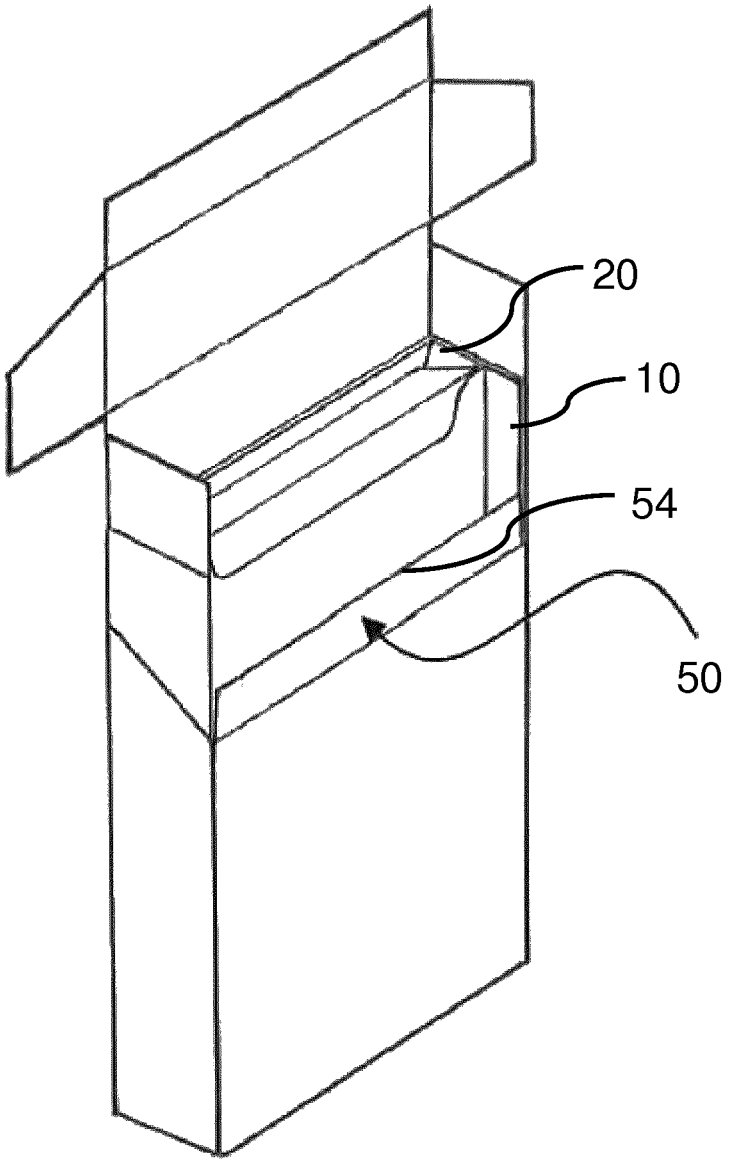
FIG. 5 shows the blank of FIG. 4 being formed around the inner frame and collation of cigarettes, where the additional flap is not folded yet.

In FIG. 5 the pack blank 30 of FIG. 4 is being formed around the inner frame 10 and the bundle of consumer articles 20. The outer dimensions of the inner frame 10 correspond to the inner dimensions of the box portion 31 of the container. The bundle of consumer articles 20 is tightly held in the space defined by the inner frame side walls 14, the inner frame front wall 12 and the box rear wall 36. In FIG. 5 the additional flap 50, provided adjacent to the upper edge of the box front wall 32, is not yet folded towards the inner frame front wall 12.

Figure 6:
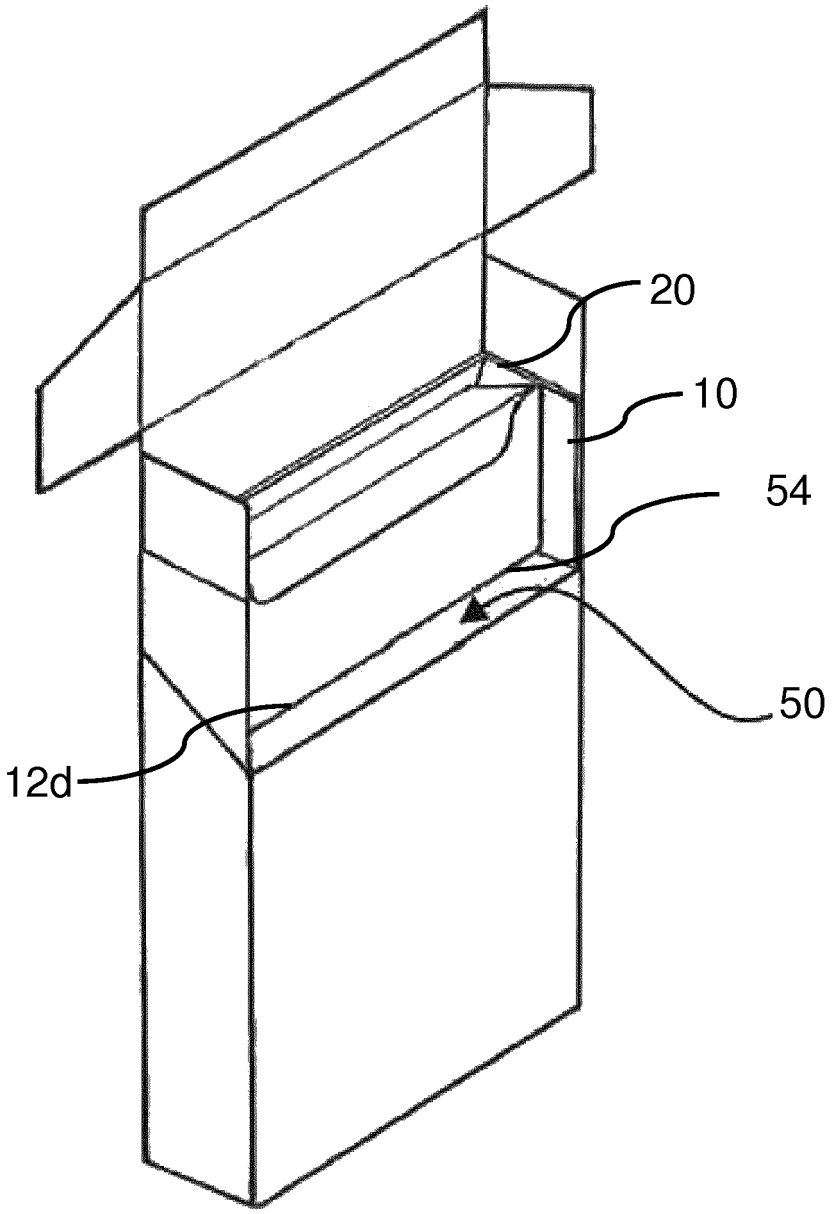
FIG. 6 shows pack blank of FIG. 4 being formed around the inner frame and collation of cigarettes after the additional flap is folded.

FIG. 6 corresponds to the container shown in FIG. 5, whereby the additional flap 50 is folded by 90 degrees towards the interior of the container. The second side edge 52 of the additional flap 50 abuts the lower edge 12*d* of the inner frame front wall 12, such that the additional flap 50 substantially covers the opening between the inner frame front wall 12 and the box front wall 32.

FIGS. 7 and 8 show cross-sectional views of the inner frame front wall 12 and the box front wall 32. The upper edge 32*a* of the box front wall is substantially on the same height as the lower edge 12*d* of the inner frame front wall 12. By folding the additional flap 50 towards the inner frame front wall 12 by 90 degrees the second side edge 54 of the additional flap 50 is locked under the lower edge 12*d* of the inner frame front wall 12. The length of the additional flap 50 corresponds to the distance between the inner frame front wall 12 and the box front wall 32.

Folding of the additional flap 50 can be done at different steps of the manufacturing process, namely before or after the box front wall 32 is folded onto the bundle of consumer articles 20. In the exemplary manufacturing process illustrated in FIGS. 1 to 7, the additional flap 50 is folded after the box front wall 32 is folded onto the bundle of consumer articles 20. Due to the natural elasticity of the card board material of the container, additional flap 50 will slightly bend when pressure is applied thereto, as indicated with the bold arrow in FIG. 7. Eventually the second side edge 54 of the additional flap 50 will reach the lower edge 12*d* of the inner frame front wall 12 and will get locked there below.

Alternatively the additional flap 50 could be folded by at least 90 degrees before the box front wall 32 is folded onto the bundle of consumer articles 20. After folding the box front wall 32 the additional flap 50 will tend to revert back to its coplanar position with respect to the box front wall 32. However, the additional flap 50 will be stopped when the second side edge 54 of the additional flap 50 abuts against the lower edge 12*d* of the inner frame front wall 12 as shown in FIG. 8.

The invention claimed is:

1. A container for consumer articles, the container comprising:

a box portion comprising a box front wall, a box rear wall and two box side walls extending between the box front wall and the box rear wall;

an inner frame comprising an inner frame front wall and inner frame side walls, wherein the inner frame front wall is arranged parallel and at a predefined distance to the box front wall, and wherein the container further comprises an additional flap comprising at least two opposing side edges, a first side edge being attached to an upper edge of the box front wall, a second side edge contacting a lower edge of the inner frame front wall, wherein the additional flap is hingedly connected to the upper edge of the box front wall: and wherein the lower edge of the inner frame front wall is at a same height as the upper edge of the box front wall, such that the additional flap extending between the upper edge of the box front wall and the lower edge of the inner frame front wall is oriented orthogonal to the box front wall and the inner frame front wall.

2. A container according to claim 1, wherein a length of the additional flap corresponds to the predefined distance between the box front wall and the inner frame front wall.

3. A container according to claim 2, wherein the additional flap comprises at least one protrusion at at least one of its outer corners at the second side edge, which protrusions are located behind the inner side walls of the inner frame, when the additional flap is folded towards the inner frame front wall.

4. A container according to claim 2, wherein the inner frame front wall comprises a reinforcing additional flap attached to the lower edge of the inner frame front wall, the reinforcing additional flap being folded by 180 degrees upwards and glued to the inner side of the inner frame front wall and the reinforcing additional flap increasing rigidity of the inner frame front wall.

5. A container according to claim 2, further comprising a collation of consumer products, which is tightly held between the box rear wall and the inner frame front wall, the collation of consumer products is wrapped in an inner liner.

6. A container according to claim 1, wherein the additional flap comprises at least one protrusion at at least one of its outer corners at the second side edge, which protrusions are located behind the inner side walls of the inner frame, when the additional flap is folded towards the inner frame front wall.

7. A container according to claim 6, wherein the inner frame front wall comprises a reinforcing additional flap attached to the lower edge of the inner frame front wall, the reinforcing additional flap being folded by 180 degrees upwards and glued to the inner side of the inner frame front wall and the reinforcing additional flap increasing rigidity of the inner frame front wall.

8. A container according to claim 7, further comprising a collation of consumer products, which is tightly held between the box rear wall and the inner frame front wall, the collation of consumer products is wrapped in an inner liner.

9. A container according to claim 8, wherein the consumer products are cigarettes.

10. A container according to claim 6, further comprising a collation of consumer products, which is tightly held between the box rear wall and the inner frame front wall, the collation of consumer products is wrapped in an inner liner.

11. A container according to claim 1, wherein the inner frame front wall comprises a reinforcing element for increasing rigidity of the inner frame front wall.

12. A container according to claim 1, wherein the reinforcing element is an additional flap attached to the lower edge of the inner frame front wall, the additional flap being folded by 180 degrees upwards and glued to the inner side of the inner frame front wall.

13. A container according to claim 1, further comprising a collation of consumer products, which is tightly held between the box rear wall and the inner frame front wall.

14. A container according to claim 13, wherein the collation of consumer products is wrapped in an inner liner.

15. A container according to claim 13, wherein the consumer products are cigarettes.

16. A process for preparing a container for consumer articles, comprising the steps of:

(a) providing collation of consumer products;

(b) providing a blank for forming an inner frame, the inner frame comprising an inner frame front wall and inner frame side walls, (c) forming an inner frame from the inner frame blank;

(d) placing the inner frame on the collation of consumer products;

(e) providing a main blank for forming a container comprising a box portion comprising a front wall, a rear wall and two side walls extending between the front wall and the rear wall, and an additional flap comprising at least two opposing side edges, a first side edge being attached to an upper edge of the box front wall, wherein the additional flap is hingedly connected to the upper edge of the box front wall;

(f) forming a container from the main blank around the inner frame and collation of consumer products;

(g) folding the additional flap such that the second side edge is in contact with a lower edge of the inner frame front wall, wherein the lower edge of the inner frame front wall is at a same height as the upper edge of the box front wall, such that the additional flap extending between the upper edge of the box front wall and the lower edge of the inner frame front wall is oriented orthogonal to the box front wall and the inner frame front wall.

17. The process of claim 16 for preparing a container for consumer articles, wherein the additional flap is folded by 90 degrees towards an interior of the container, such that the additional flap covers a gap between the upper edge of the box front wall and the lower edge of the inner frame front wall.

18. The process of claim 17 for preparing a container for consumer articles, wherein the additional flap is folded by 90 degrees before step (f).

19. The process of claim 17 for preparing a container for consumer articles, wherein the additional flap is folded by 90 degrees after step (f).

20. The process of claim 16 for preparing a container for consumer articles, wherein an additional flap is attached to the lower edge of the inner frame front wall, the additional flap being folded by 180 degrees inwards and glued to the inner side of the inner frame front wall.

* * * * *